US011274857B2

(12) United States Patent
Amthor et al.

(10) Patent No.: US 11,274,857 B2
(45) Date of Patent: Mar. 15, 2022

(54) CRYOGENIC COOLING SYSTEM WITH TEMPERATURE-DEPENDENT THERMAL SHUNT

(71) Applicant: KONINKLIJKE PHILIPS N.V., Eindhoven (NL)

(72) Inventors: Thomas Erik Amthor, Eindhoven (NL); Miha Fuderer, Eindhoven (NL); Gerardus Bernardus Jozef Mulder, Eindhoven (NL); Christoph Leussler, Eindhoven (NL); Peter Forthmann, Eindhoven (NL); Philippe Abel Menteur, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 470 days.

(21) Appl. No.: 15/778,082

(22) PCT Filed: Nov. 24, 2016

(86) PCT No.: PCT/EP2016/078612

§ 371 (c)(1),
(2) Date: May 22, 2018

(87) PCT Pub. No.: WO2017/093101

PCT Pub. Date: Jun. 8, 2017

(65) Prior Publication Data

US 2018/0347866 A1 Dec. 6, 2018

Related U.S. Application Data

(60) Provisional application No. 62/263,363, filed on Dec. 4, 2015.

(30) Foreign Application Priority Data

Mar. 8, 2016 (EP) ..... 16159189

(51) Int. Cl.
*F25B 9/14* (2006.01)
*F25B 9/10* (2006.01)
(Continued)

(52) U.S. Cl.
CPC ..... *F25B 9/145* (2013.01); *F25B 9/10* (2013.01); *F25D 19/006* (2013.01); *H01F 6/04* (2013.01)

(58) Field of Classification Search
CPC .... F25B 9/10; F25B 9/14; F25B 9/145; H01F 6/04; F25D 19/00; F25D 19/006; F04B 37/08; F04B 37/085
See application file for complete search history.

(56) References Cited

U.S. PATENT DOCUMENTS 5,111,667 A 5/1992 Haefner et al.
5,394,129 A 2/1995 Obasih
(Continued)

FOREIGN PATENT DOCUMENTS

EP 0126909 A2 12/1984
JP H09166365 A * 6/1997
(Continued)

OTHER PUBLICATIONS

D. Bugby and C. Stouffer, Development of Advanced Cryogenic Integration Solutions (Year: 1999).*
(Continued)

*Primary Examiner* — Frantz F Jules
*Assistant Examiner* — Webeshet Mengesha

(57) ABSTRACT

A cryogenic cooling system (10) comprising a cryostat (12), a two-stage cryogenic cold head (24) and at least one thermal connection member (136; 236; 336; 436) that is configured to provide at least a portion of a heat transfer path (138; 238; 338; 438) from the second stage member (30) to the first stage member (26) of the two-stage cryogenic cold
(Continued)

head (24). The heat transfer path (138; 238; 338; 438) is arranged outside the cold head (24). A thermal resistance of the provided at least portion of the heat transfer path (138; 238; 338; 438) at the second cryogenic temperature is larger than a thermal resistance of the provided at least portion of the heat transfer path (138; 238; 338; 438) at the first cryogenic temperature.

15 Claims, 6 Drawing Sheets

(51) Int. Cl.
*F25D 19/00* (2006.01)
*H01F 6/04* (2006.01)

(56) References Cited

U.S. PATENT DOCUMENTS 5,913,889 A 6/1999 Buelow et al.
2006/0022779 A1* 2/2006 Jiang ..... F25D 19/006 335/216
2009/0193818 A1 8/2009 Tigwell et al.
2010/0313574 A1 12/2010 Koyangi et al.
2013/0023418 A1* 1/2013 Ackermann ..... F25B 9/10 505/162
2014/0130520 A1* 5/2014 Snow ..... F25D 19/00 62/6
2015/0196221 A1* 7/2015 Garside ..... A61B 5/055 600/410
2015/0338151 A1* 11/2015 Miki ..... F25D 3/10 62/51.1

FOREIGN PATENT DOCUMENTS

JP 10188754 7/1998
JP 2001085220 A 3/2001
JP 2002151319 A 5/2002
JP 2002367823 A 12/2002
JP 2005172597 A 6/2005
JP 2006038711 A 2/2006
JP 2009074774 A 4/2009

OTHER PUBLICATIONS

Woodcraft et al "A Low Temperature Thermal Conductivity Database" CP1185, Low Temperature Detectors Ltd 13, Proceedings of the 13th International Workshop, AIP 2009.
Prenger et al., Nitrogen heat pipe for cryocooler thermal shunt,Adv. Cryo. Eng. 41, 147 (1996).
Chang, Ho-Myung & Kim, Hyung-Jin. (2000). Development of a thermal switch for faster cool-down by two-stage cryocooler Cryogenics, 40(12), 769-777. doi:10.1016/S0011-2275(01)00034-0.
Uhlig, Thermal shunt for quick cool-down of two-stage closed-cycle refrigerator, Cryogenics 42 (2002).

* cited by examiner

CRYOGENIC COOLING SYSTEM WITH TEMPERATURE-DEPENDENT THERMAL SHUNT

CROSS REFERENCE TO RELATED APPLICATIONS

This application is a U.S. national phase application of International Application No. PCT/EP2016/078612, filed on Nov. 24, 2016, which claims the benefit of U.S. provisional Application Serial No. 62/263,363 filed on Dec. 4, 2015 and EP 16159189.6 filed Mar. 8, 2016, which are incorporated herein by reference.

FIELD OF THE INVENTION

The invention pertains to a cryogenic cooling system with a two-stage cold head, and in particular comprising a superconducting magnet coil for use in a magnetic resonance examination apparatus.

BACKGROUND OF THE INVENTION

Two-stage cryocoolers are frequently employed as a cooling source for cooling down devices to cryogenic temperatures. Typical examples of commercially available two-stage cryocoolers using helium gas as a working fluid are Gifford-McMahon (GM) refrigerator systems and pulse tube (PT) refrigerator systems. They allow cooling down samples, devices and other equipment without the inconvenience and expense of the use of liquid helium. In particular, such devices can include superconducting materials that exhibit their superconducting properties when cooled below a specific temperature that is known as the critical temperature. A typical example for such a device is a superconducting magnet system which is intended to generate a static magnetic field when being operated in a persistent mode, as is well known in the art.

A first stage of the two-stage cryocooler is usually kept at a temperature between 50 K and 100 K, and may be thermally connected to a thermal radiation shield surrounding an inner region that is configured to receive a device to be cooled down to a lower temperature, for instance down to 4K. The device is thermally coupled to a second stage of the two-stage cryocooler.

Typically, the cooling capacity of the first stage is much larger, by one or two orders of magnitude, than that of the second stage. As a consequence, a time required for cooling down the inner region to the nominal temperature of the second stage is much longer than a time required for cooling down the inner region to the nominal temperature of the first stage, when starting to cool down from room temperature.

Patent document U.S. Pat. No. 5,111,667 A describes a two-stage cryopump having a refrigerator that includes a first stage, a second stage being colder than the first stage and a condensation member that has a condensation surface. A first coupler is configured for connecting the condensation member to the second stage in a thermally conducting manner. An adsorption member comprising an adsorption surface is spaced from the condensation member. A second coupler is configured for connecting the adsorption member to the second stage in a heat conducting manner. There is further provided a heater for heating the adsorption member during time periods for regenerating the adsorption member. The second coupler is so designed that it thermally sufficiently insulates the adsorption member from the second stage and from the condensation member at least during heating periods of the adsorption member, for preventing heating the condensation member by the heater.

SUMMARY OF THE INVENTION

It is therefore an object of the invention to provide a cryogenic cooling system with an efficient operation and a reduced time for cooling down from ambient to cryogenic temperatures.

In one aspect of the present invention, the object is achieved by cryogenic cooling system, comprising a cryostat having an outer enclosure and at least one thermal shield disposed within the outer enclosure. The at least one thermal shield defines an inner region, and a thermal insulation region is defined by and between the at least one thermal shield and the outer enclosure.

The cryogenic cooling system further includes a cryogenic cold head having a first stage member at least partially disposed in the thermal insulation region, wherein the first stage member is configured to operate in a stationary state at a first cryogenic temperature, and includes a thermally conductive link member that is thermally connected to the at least one thermal shield, at least a second stage member at least partially disposed in the inner region, wherein the second stage member is configured to operate in a stationary state at a second cryogenic temperature that is lower than the first cryogenic temperature, and at least one thermal connection member that is configured to provide, in at least one operational state of the cryogenic cooling system, at least a portion of a heat transfer path from the second stage member to the first stage member, wherein the heat transfer path is arranged outside the cold head, and a thermal resistance of the provided at least portion of the heat transfer path at the second cryogenic temperature is larger than a thermal resistance of the provided at least portion of the heat transfer path at the first cryogenic temperature.

The phrase "thermally connected to the first (second) stage member", as used in this application, shall be understood particularly as being thermally connected to at least one out of a heat conductive member that, in turn, is thermally connected to the first (second) stage member, and directly to the first (second) stage member.

The phrase "thermally connected", as used in this application, shall be understood particularly as a mechanical connection that enables heat transfer by heat conduction.

The phrase "heat transfer path", as used in this application, shall be understood particularly as a path along which heat is transferred via heat conduction, and a path of heat transfer by radiation shall be explicitly excluded.

The phrase "thermal resistance", as used in this application, shall be understood particularly as a ratio of a temperature difference between two locations along a heat transfer path and a thermal power (amount of thermal energy per time) being transferred between the two locations.

The phrase "cryogenic temperature", as used in this application, shall be understood particularly as a temperature that is lower than 100 K.

The operation of cryocooler systems is usually based on a closed-loop expansion cycle, using helium as a working fluid. A complete cryocooler system comprises two major components: a compressor unit, which compresses the working fluid and removes heat from the system, and a cold head, which is configured to take the working fluid through expansion cycles to cool it down to cryogenic temperatures.

The term "cold head", as used in this application, shall particularly be understood in this sense.

It is noted herewith that the terms "first", "second", etc. are used for distinction purposes only and are not meant to indicate a sequence or a priority in any way.

As the thermal resistance of the provided at least portion of the heat transfer path at the first cryogenic temperature is lower that at the second cryogenic temperature, the second stage can be cooled down via the provided at least one thermal connection member faster and in a more efficient manner while, with the second stage member at the second cryogenic temperature, the thermal resistance of the provided at least portion of the heat transfer path can be designed large enough to prevent an intolerably high heat load on the second stage member. In this way, a higher cooling efficiency of the first stage member of the cryogenic cold head can be used to remove a large amount of heat from the second stage member in the beginning of a cooldown procedure. A time for cooling down the inner region from ambient to cryogenic temperatures can advantageously be reduced.

In a preferred embodiment, the thermal resistance of the provided at least portion of the heat transfer path at the second cryogenic temperature is at least 10 times larger than a thermal resistance of the provided at least portion of the heat transfer path at the first cryogenic temperature.

More preferably, the thermal resistance at the second cryogenic temperature is at least 100 times larger, and, most preferably, at least 1000 times larger than the thermal resistance at the first cryogenic temperature.

In this way, a substantial reduction of a time for cooling down the inner region from ambient to cryogenic temperatures can be achieved.

In another preferred embodiment, the at least one thermal connection member comprises a plurality of carbon fibers, each carbon fiber having two ends, and wherein one end of the carbon fibers of the plurality of carbon fibers is thermally connected to the first stage member, and the other end of the carbon fibers of the plurality of carbon fibers is thermally connected to the second stage member.

The phrase "plurality", as used in this application, shall in particular be understood as a quantity of at least two.

At temperatures above 50 K, carbon fibers can exhibit an extraordinary high thermal conductance. At room temperature, the thermal conductance can be as high as 1000 W/(m*K), much higher than that of copper. Due to this, a low thermal resistance between the two first stage member and the second stage member can be achieved, and the more powerful and more efficient first stage member can directly cool the second stage member and its thermal load, thereby quickly decreasing its temperature.

In contrast to other thermally well-conducting materials, the thermal conductivity of carbon fibers drops very quickly at lower temperatures. The thermal conductivity of graphite, which is comparable to that of carbon fibers in longitudinal direction, is shown in FIG. 1 below as a dotted line (from: Woodcraft et al., *A low temperature thermal conductivity database,* CP1185, Low Temperature Detectors LTD 13, Proceedings of the 13th International Workshop, AIP 2009). In the relevant temperature range for the cryocooler (from about 300 K to 4K), the thermal conductivity decreases by about four orders of magnitude.

When during cooling down from ambient temperature a momentary temperature of the at least one thermal connection member is decreasing, its thermal conductivity therefore drops dramatically, until the first stage member and the second stage member are thermally virtually disconnected. At temperatures below the first cryogenic temperature, the second stage member can then cool down the inner region further to temperatures below the first cryogenic temperature.

Preferably, the carbon fibers of the plurality of carbon fibers are not mutually mechanically connected, for instance by use of a resin, and are neither encapsulated, so that no additional conductive heat transfer through other materials is enabled. By that, a beneficial large difference of a thermal resistance of the provided at least portion of the heat transfer path at the first cryogenic temperature and at the second cryogenic temperature can be achieved.

Pure carbon fibers are commercially available, for instance as yarns, commonly consisting between 1,000 ("1K", 67 tex=67 g/1,000 m) and 48,000 ("48K", 3,200 tex) filaments/yarn, and as woven tissues.

In one embodiment, the plurality of carbon fibers is thermally connected to at least one out of the first stage member and the second stage member by at least one force-locking connection. In this way, a low thermal resistance of an interface between the plurality of carbon fibers and the respective stage member can be accomplished.

In some embodiments, this can beneficially be accomplished when the plurality of carbon fibers is thermally connected to at least one out of the first stage member and the second stage member by at least one adhesive joint.

In another preferred embodiment of the cryogenic cooling system, the at least one thermal connection member comprises a bimetal member. The bimetal member has a first end and a second end. The first end is fixedly attached and thermally connected to the second stage member. The second end is configured to apply a mechanical surface pressure larger than zero towards at least one out of a heat conductive member that is thermally connected to the first stage member and the first stage member if a temperature of the second stage member is higher than the first cryogenic temperature. If the temperature of the second stage member is lower than the first cryogenic temperature, the second end is configured to apply zero mechanical surface pressure towards both the heat conductive member that is thermally connected to the first stage member and the first stage member.

In this way, a thermal resistance of the provided at least portion of the heat transfer path is infinite at the second cryogenic temperature, and the first stage member and the second stage member can be thermally disconnected at the second cryogenic temperature, while at the first cryogenic temperature, at least a portion of a heat transfer path from the second stage member to the first stage member can be provided with a low thermal resistance. In the temperature region between the first cryogenic temperature and the second cryogenic temperature, a thermal resistance of an interface of the second end of the bimetal member and the first stage member beneficially increases from a specific value at the first cryogenic temperature to an infinite value at the second cryogenic temperature due to a varying surface pressure exerted by the bimetal member on a location of contact to the at least one out of a heat conductive member that is thermally connected to the first stage member and the first stage member.

A multiplied effect on the time required to cool down the inner region from ambient to cryogenic temperatures can be accomplished if the cryogenic cooling system comprises a plurality of thermal connection members. Each thermal connection member comprises a bimetal member. Each bimetal member has a first end and a second end. The first end is fixedly attached to the second stage member, the second end is configured to apply a mechanical surface pressure larger than zero towards at least one out of a heat conductive member thermally connected to the first stage member and the first stage member if a temperature of the second stage member is higher than the first cryogenic temperature, and the second end is configured to apply zero mechanical surface pressure towards both the heat conductive member thermally connected to the first stage member and the first stage member if the temperature of the second stage member is lower than the first cryogenic temperature.

In one embodiment, the at least one thermal connection member or at least one out of the plurality of thermal connection members besides a bimetal member further comprises a plurality of carbon fibers. Each carbon fiber has a first end and a second end. The first ends of the carbon fibers of the plurality of carbon fibers are permanently thermally connected to the second stage member. The second ends of the carbon fibers of the plurality of carbon fibers are arranged between the second end of the bimetal member and one out of the heat conductive member thermally connected to the first stage member and the first stage member.

In this way, each bimetal member can beneficially exert a temperature-dependent surface pressure on a plurality of carbon-fibers on a location of contact of the plurality of carbon-fibers to the one out of the heat conductive member thermally connected to the first stage member and the first stage member. Furthermore, tolerance requirements for an assembly of the at least one thermal connection member or the at least one out of the plurality of thermal connection members can be reduced.

It is important that the plurality of carbon fiber is permanently thermally connected to the second stage member, while having a bimetal pressure-dependent attachment at the first stage member. When the second stage member is at the second cryogenic temperature, a thermal resistance of an interface between the plurality of carbon fibers and the first stage member is larger than in the warm state, i.e. at temperatures larger than the first cryogenic temperature. By that, the bimetal helps to keep the plurality of carbon fibers at a temperature that is close to the second cryogenic temperature, thus making them virtually thermally non-conducting over their whole length.

In one embodiment, the at least one thermal connection member or at least one out of the plurality of thermal connection members besides a bimetal member further comprises a plurality of carbon fibers. Each carbon fiber has a first end and a second end. The first ends of the carbon fibers of the plurality of carbon fibers are permanently thermally connected to the second stage member. The second ends of the carbon fibers of the plurality of carbon fibers are attached to the second end of the bimetal member.

In this way, the plurality of carbon fibers is attached to the bimetal member at its second end, which is arranged proximal to the first stage member. A thermal conductance across the plurality of carbon fibers, i.e. over the distance from the first stage member to the bimetal member is relatively low, resulting in a low heat load for the second stage member being at the second cryogenic temperature.

Preferably, the second end of the carbon fibers of the plurality of carbon fibers is attached to the second end of the bimetal member by use of an adhesive.

In another preferred embodiment, the at least one thermal connection member or at least one out of the plurality of thermal connection members comprises two bimetal members, each bimetal member having a first end and a second end, that are arranged to oppose each other.

One of the two bimetal members is thermally connected with the first end to the first stage member. The other one of the two bimetal members is thermally connected with the first end to the second stage member. The second ends of the two bimetal members are configured to cooperate and to apply a mechanical surface pressure larger than zero towards each other if a temperature of the second stage member is higher than the first cryogenic temperature. The second ends of the two bimetal members are configured to apply zero mechanical surface pressure towards each other if a temperature of the second stage member is lower than the first cryogenic temperature.

By that, a beneficially large contact area between the second ends of the two bimetal members can be achieved if a temperature of the second stage member is higher than the first cryogenic temperature, and requirements regarding assembly tolerances for the at least one thermal connection member or the at least one out of the plurality of thermal connection members can be reduced.

Preferably, a total thickness of the at least one bimetal member is selected to lie in a range between 0.1 mm and 2 mm. In this way, a sufficiently low thermal resistance of the provided at least portion of the heat transfer path can be provided at the first cryogenic temperature in order to create a substantial effect of time reduction for cooling down the inner region from ambient to cryogenic temperatures. Moreover, a sufficient amount of bending of the bimetal member can be achieved to create a thermal resistance of infinite value for the interface of the second end of the bimetal member and the first stage member at the second cryogenic temperature, and a heat transfer path from the second stage member to the first stage member with a low thermal resistance at the first cryogenic temperature can be accomplished for a wide range of commonly used cryostat sizes.

Moreover, a thermo-mechanical shearing force that is present between the two metals of the bimetal member and that is required for bending the bimetal member is kept within reasonable limits such that material fatigue or material damage can be avoided.

In another aspect of the invention, the cryogenic cooling system further includes a superconducting magnet coil that is configured to provide a quasi-static magnetic field and that is suitable for use in a magnet resonance examination apparatus. The superconducting magnet coil is arranged within the inner region and is thermally connected to the second stage member, and the second cryogenic temperature is lower than a critical temperature of the superconducting magnet coil. By that, a superconducting magnet coil for magnet resonance examination can be provided that can be cooled down from ambient temperature to the second cryogenic temperature in a fast and effective way.

BRIEF DESCRIPTION OF THE DRAWINGS

These and other aspects of the invention will be apparent from and elucidated with reference to the embodiments described hereinafter. Such embodiment does not necessarily represent the full scope of the invention, however, and reference is made therefore to the claims and herein for interpreting the scope of the invention.

In the drawings.

DETAILED DESCRIPTION OF EMBODIMENTS

Figure 1:
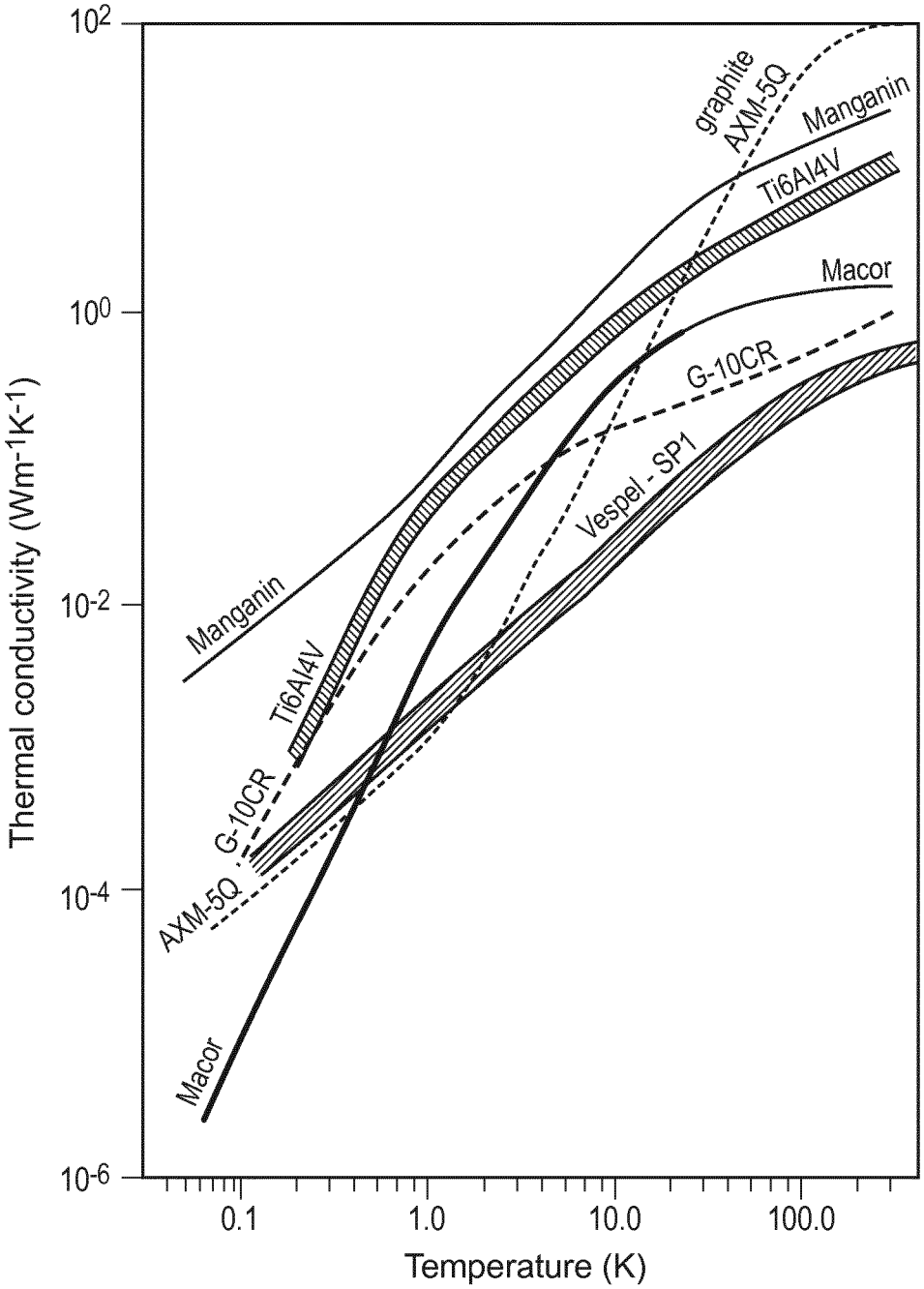
FIG. 1 illustrates thermal conductivity properties of graphite in a range of cryogenic temperatures in comparison to other selected materials.

FIG. 1 is a graphical representation of thermal conductivity as a function of temperature.

Figure 2:
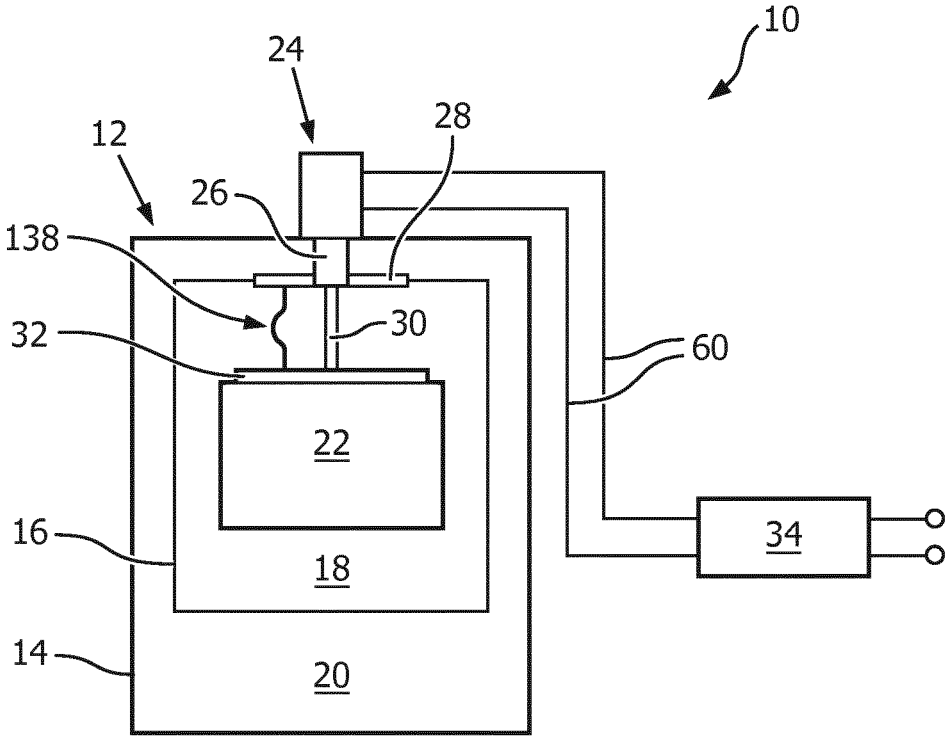
FIG. 2 shows a schematic illustration of a cryogenic cooling system in accordance with the invention.

FIG. 2 shows a schematic illustration of a cryogenic cooling system 10 in accordance with the invention. The cryogenic cooling system 10 includes a cryostat 12 having an outer enclosure 14 and a thermal shield 16 disposed within the outer enclosure 14. The thermal shield 16 defines an inner region 18 within which a superconducting magnet coil 22 of the cryogenic cooling system 10 is arranged. The superconducting magnet coil 22 is configured to provide a quasi-static magnetic field with a magnet field strength of several Tesla and is suitable for use in a magnet resonance examination apparatus. The superconducting magnet coil 22 is designed for nominal operation at a temperature of 4 K, which is sufficiently below a critical temperature of 10 K of a niobium-titanium (NbTi) superconducting wire forming windings of the superconducting magnet coil 22.

A thermal insulation region 20 of the cryostat 12 is defined by and between the thermal shield 16 and the outer enclosure 14. The thermal insulation region 16 may include thermal insulation materials such as the widely used multi-layer insulation (MLI).

The cryogenic cooling system 10 further includes a two-stage cryogenic cold head 24. The cryogenic cold head 24 has a first stage member 26 that is disposed in the thermal insulation region 20. The first stage member 26 is configured to operate in a stationary state at a first cryogenic temperature of 70 K, and includes a thermally conductive link member 28 formed by a connecting metal flange that is thermally connected to the first stage member 26 and the thermal shield 16. Furthermore, the cryogenic cold head 24 has a second stage member 30 that is disposed in the inner region 18. The second stage member 24 is configured to operate in a stationary state at a second cryogenic temperature of 4 K that is lower than the first cryogenic temperature, and that corresponds to the temperature for nominal operation of the superconducting magnet coil 22. The superconducting magnet coil 22 is thermally connected to the second stage member 30 by another heat conductive member formed by a metal flange 32 that is made from copper.

The cold head 24 is connectable to an electrically driven compressor unit 34 that is configured to provide a compressed working fluid formed by gaseous helium to the cold head 24 via gas pipes. This part of the technology is well known in the art and need therefore not be described in further detail herein. The cold head 24 is able to cool down the superconducting magnet coil 22 down from an ambient temperature of about 300 K down to the second cryogenic temperature of 4 K.

Figure 3:
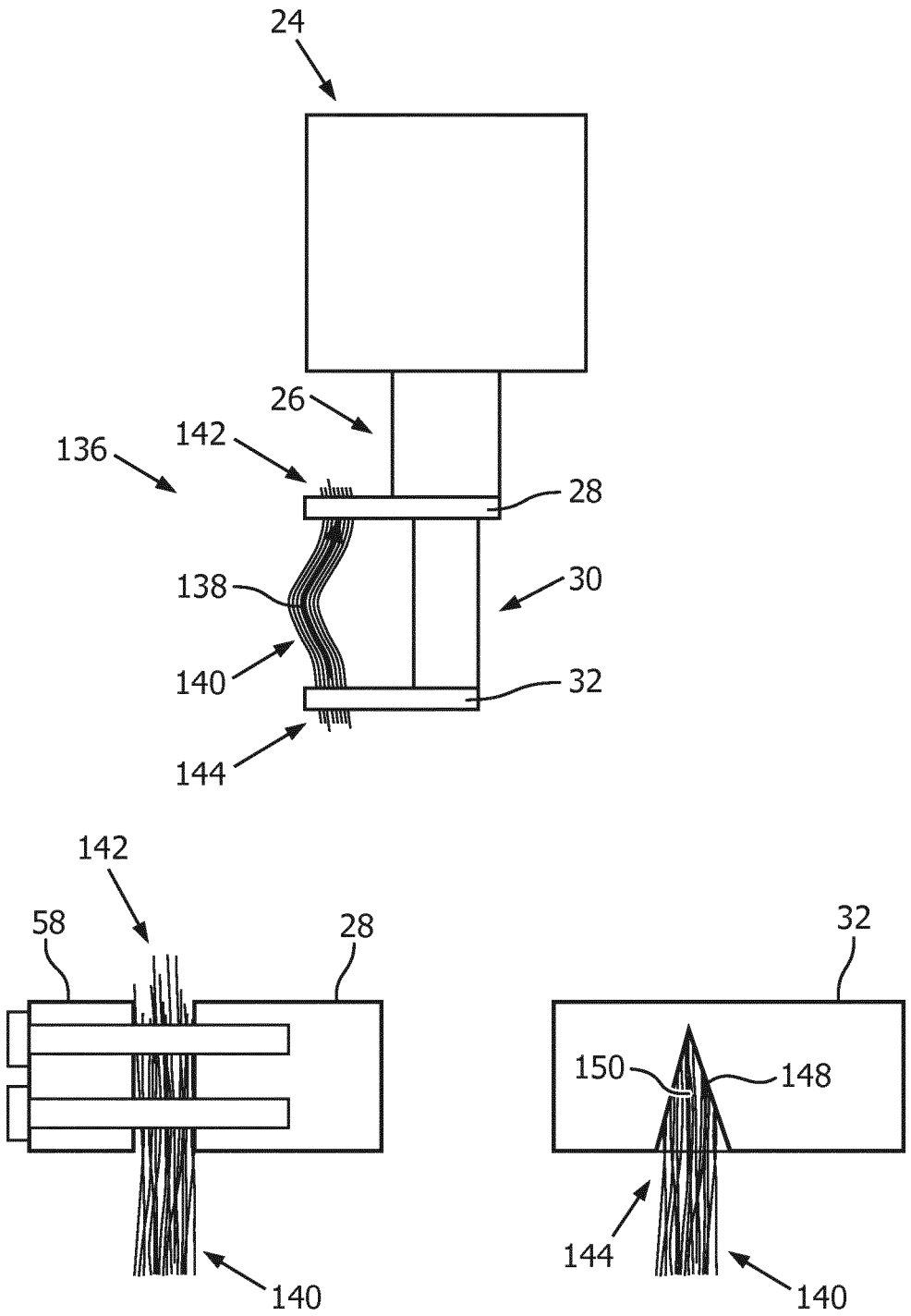
FIG. 3 is a schematic illustration of the two-stage cold head, comprising a thermal connection member, of the cryogenic cooling system pursuant to FIG. 1.

FIG. 3 is a schematic illustration of the two-stage cold head 24 of the cryogenic cooling system 10 pursuant to FIG. 2 and shows a thermal connection member 136 that is configured to provide, in an operational state of the cryogenic cooling system 10 of cooling down the superconducting magnet coil 22 from an ambient temperature of about 300 K to the second cryogenic temperature of 4 K, a heat transfer path 138 that is arranged outside the cold head 24 from the second stage member 30 to the first stage member 26.

The thermal connection member 136 comprises a plurality of carbon fibers 140 formed as a 12K yarn. Each carbon fiber has two ends 142, 144, and one end 142 of the carbon fibers 140 of the plurality of carbon fibers 140 is thermally connected to the first stage member 26 via the thermally conductive link member 28 by force-locking connections formed as screw connections, by which the ends 142 of the carbon fibers 140 are pressed between a metal plate 58 and the connecting metal flange (bottom left hand side of FIG. 3). The other ends 144 of the carbon fibers 140 of the plurality of carbon fibers 140 are thermally connected to the second stage member 30 via the connecting copper flange 32 by an adhesive joint (bottom right hand side of FIG. 3). To this end, the connecting copper flange 32 comprises a conical cut-out 148 filled with a thermally well-conducting epoxy resin 150 into which the ends 144 of the plurality of carbon fibers 140 had been placed during curing of the epoxy resin 150. The conical shape of the cut-out 148 has an increased surface area which results in a lower thermal contact resistance between the ends 142, 144 of the carbon fibers 140 and the connecting copper flange 32.

Although in this specific embodiment the ends 142, 144 of the plurality of carbon fibers 140 are thermally connected to the first stage member 26 by force-locking connections, and the other ends 144 of the plurality of carbon fibers 140 are thermally connected to the second stage member 30 by an adhesive joint, it is also contemplated to provide an adhesive joint for thermally connecting the plurality of carbon fibers to the first stage member and to provide force-locking connections for thermally connecting the ends of the plurality of carbon fibers to the second stage member, or to provide force-locking connections at both ends of the plurality of carbon fibers, or to provide adhesive joints at both ends of the plurality of carbon fibers.

Due to the thermal conductivity properties of the plurality of carbon fibers 140, a thermal resistance of the provided heat transfer path 138 is larger at the second cryogenic temperature than a thermal resistance of the provided heat transfer path 138 at the first cryogenic temperature.

From the thermal conductivity properties of carbon fibers ("graphite AXM-5Q") at the first cryogenic temperature of 70 K and the second cryogenic temperature of 4 K provided in FIG. 1 it can be estimated that the thermal resistance of the provided heat transfer path 138 at the second cryogenic temperature is more than 2,000 times larger than the thermal resistance of the provided heat transfer path 138 at the first cryogenic temperature. In other words, at the first cryogenic temperature an effective heat transfer path 138 is provided from the second stage member 30 to the first stage member 26, whereas at the second cryogenic temperature the first stage member 26 and the second stage member 30 are, from a practical perspective, thermally disconnected.

In the following, several alternative embodiments of thermal connection members in accordance with the invention are disclosed. The individual alternative embodiments are described with reference to a particular figure and are identified by a prefix number of the particular alternative embodiment, beginning with "1". Features whose function is the same or basically the same in all embodiments are identified by reference numbers made up of the prefix number of the alternative embodiment to which it relates, followed by the number of the feature. If a feature of an alternative embodiment is not described in the corresponding figure depiction, the description of a preceding embodiment should be referred to.

Figure 4:
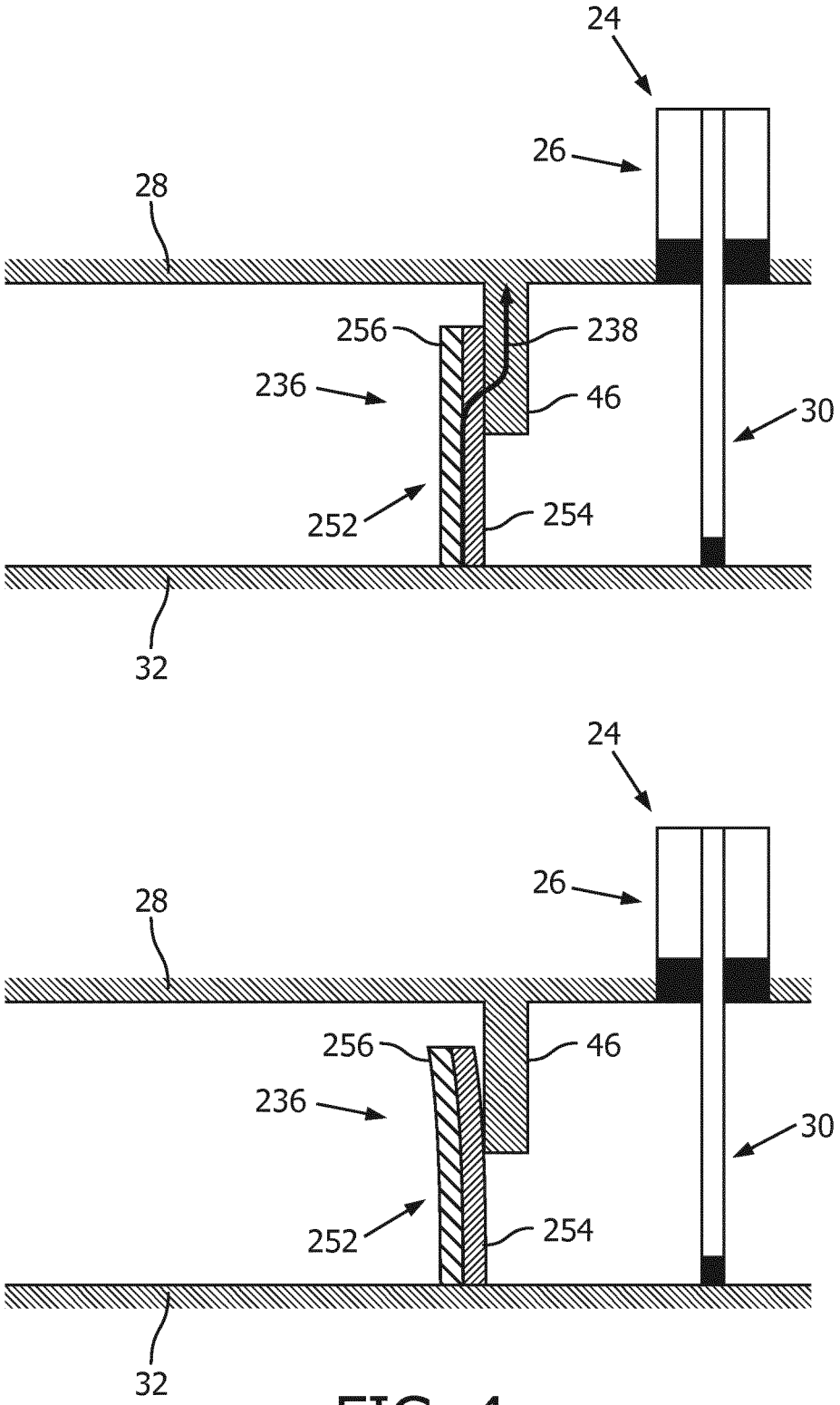
FIG. 4 is a schematic illustration of an alternative embodiment of a thermal connection member.

FIG. 4 is a schematic illustration of an alternative embodiment of a thermal connection member 236. The thermal connection member 236 comprises a bimetal member 252 formed as a rectangular sheet having a first end 254 and a second end 256. A total thickness of the bimetal member 252 is 0.5 mm. In this specific embodiment, the bimetal member 252 comprises a sheet side made of copper and an opposing sheet side made of stainless steel. However, other combinations of metals that appear suitable to those skilled in the art are also contemplated.

The first end 254 of the bimetal member 252 is fixedly attached and thermally connected to the second stage member 30 via the connecting copper flange 32. A heat conductive member 46 formed as a metal plate made from copper is fixedly attached and thermally connected to the first stage member 26 and protrudes from the thermally conductive link member 28 towards the second end 256 of the bimetal member 252. The top part of FIG. 4 shows the thermal connection member 236 at a temperature that is higher than the first cryogenic temperature. Under this condition, the copper side of the second end 256 of the bimetal member 252 is in mechanical contact with a side of the metal plate and applies a temperature-dependent surface pressure larger than zero towards the side of the heat conductive member 46. By that, a heat transfer path 238 with a low thermal resistance is provided from the second stage member 30 to the first stage member 26.

When, during a cooling down procedure from ambient temperature to the second cryogenic temperature, a momentary temperature of the second stage member 30 becomes equal to the first cryogenic temperature, the second end 256 of the bimetal member 252 applies zero mechanical surface pressure towards the heat conductive member 46. When a momentary temperature of the second stage member 30 is lower than the first cryogenic temperature, a gap exists between the copper side of the second end 256 of the bimetal member 252 and the heat conductive member 46, and a thermal resistance of the provided heat transfer path 238 becomes infinite. This condition is illustrated in the bottom part of FIG. 4.

Without further illustration it will be readily appreciated by those skilled in the art that the cryogenic cooling system 10 may comprise a plurality of thermal connection members 236, wherein some of the thermal connection members 236 may comprise a bimetal member 252 of the kind described before. In this way, a plurality of heat transfer paths 238 that are arranged in parallel can be provided from the second stage member 30 to the first stage member 26 when a momentary temperature of the second stage member 30 is higher than the first cryogenic temperature. At a momentary temperature of the second stage member 30 that is lower than the first cryogenic temperature, the thermal resistance of the provided parallel heat transfer paths 238 will be infinite.

Figure 5:
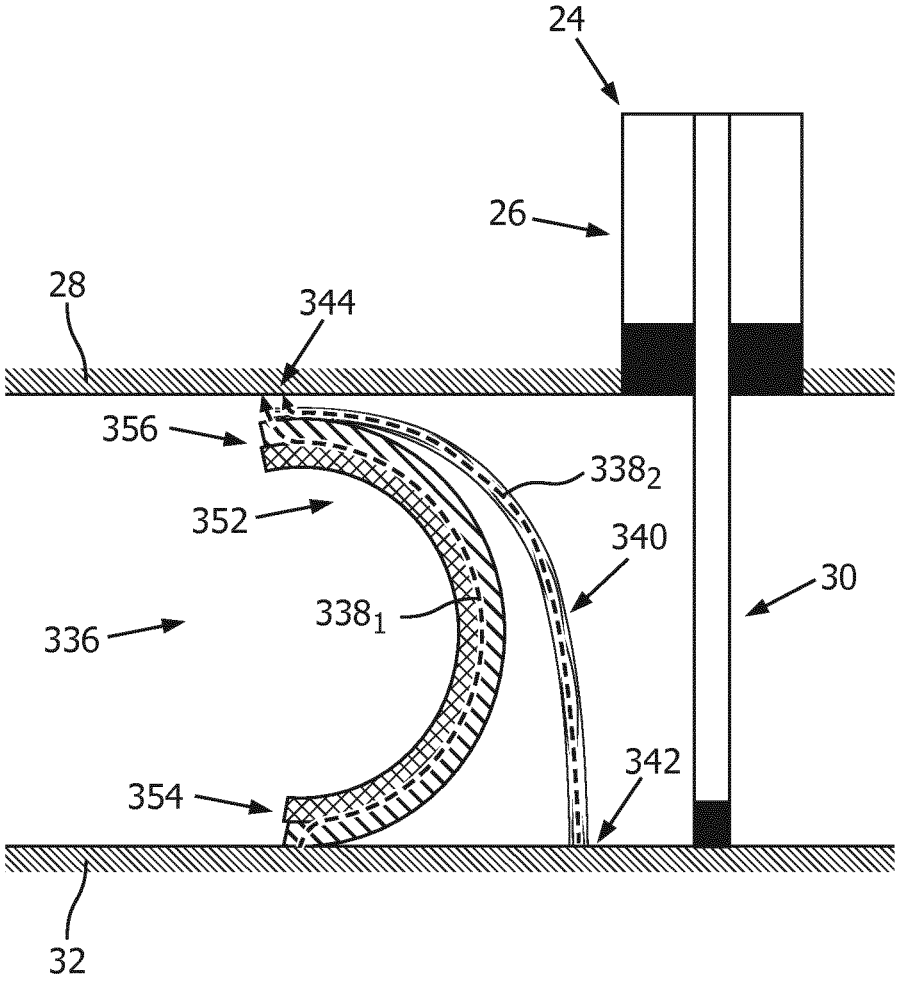
FIG. 5 is a schematic illustration of another alternative embodiment of a thermal connection member.

FIG. 5 is a schematic illustration of another alternative embodiment of a thermal connection member 336. The alternative embodiment of the thermal connection member 336 will exemplarily be described for a single specimen. However, as explained before, the cryogenic cooling system 10 may comprise one thermal connection member 336 or a plurality of thermally connection members 336.

The thermal connection member 336 comprises, besides a bimetal member 352 having a first end 354 and a second end 356, a plurality of carbon fibers 340 formed as a 24K yarn. The first end 354 of the bimetal member 352 is fixedly attached and thermally connected to the connecting metal flange 32 made of copper that, in turn, is thermally connected to the second stage member 30. The second end 356 of the curved bimetal member 352 is directed towards the thermally conductive link member 28 formed as a metal flange that is thermally connected to the first stage member 26. The carbon fibers 340 have first ends 342 and second ends 344. The first ends 342 of the carbon fibers 340 of the plurality of carbon fibers 340 are permanently thermally connected to the connecting metal flange 32 that, in turn, is thermally connected to the second stage member 30. This thermal connection may, for instance, be established by a clamped joint (not shown). The second ends 344 of the carbon fibers 340 of the plurality of carbon fibers 340 are adhesively attached to the second end 356 of the bimetal member 352 and are arranged between the second end 356 of the bimetal member 352 and the thermally conductive link member 28.

FIG. 5 illustrates a situation in which, during a cooling down procedure from ambient temperature (300 K) to the second cryogenic temperature of 4 K, a momentary temperature of the second stage member 30 has fallen below the first cryogenic temperature of 70 K. The bimetal member 352 has curved far enough to move the plurality of carbon fibers 340 away from the thermally conductive link member 28 such that a thermal resistance of conductive heat transfer paths $\mathbf{338}_1$, $\mathbf{338}_2$ between the first stage member 26 and the second stage member 30 is infinite. For momentary temperatures of the second stage member 330 between ambient temperature and the first cryogenic temperatures, the bimetal member 352 is more straightened, and the second end 356 of the bimetal member 352 applies a temperature-dependent mechanical surface pressure larger than zero towards the plurality of carbon fibers 340 and the thermally conductive link member 28 to provide a heat transfer path 338 from the second stage member 30 to the first stage member 26 with a low thermal resistance.

Figure 6:
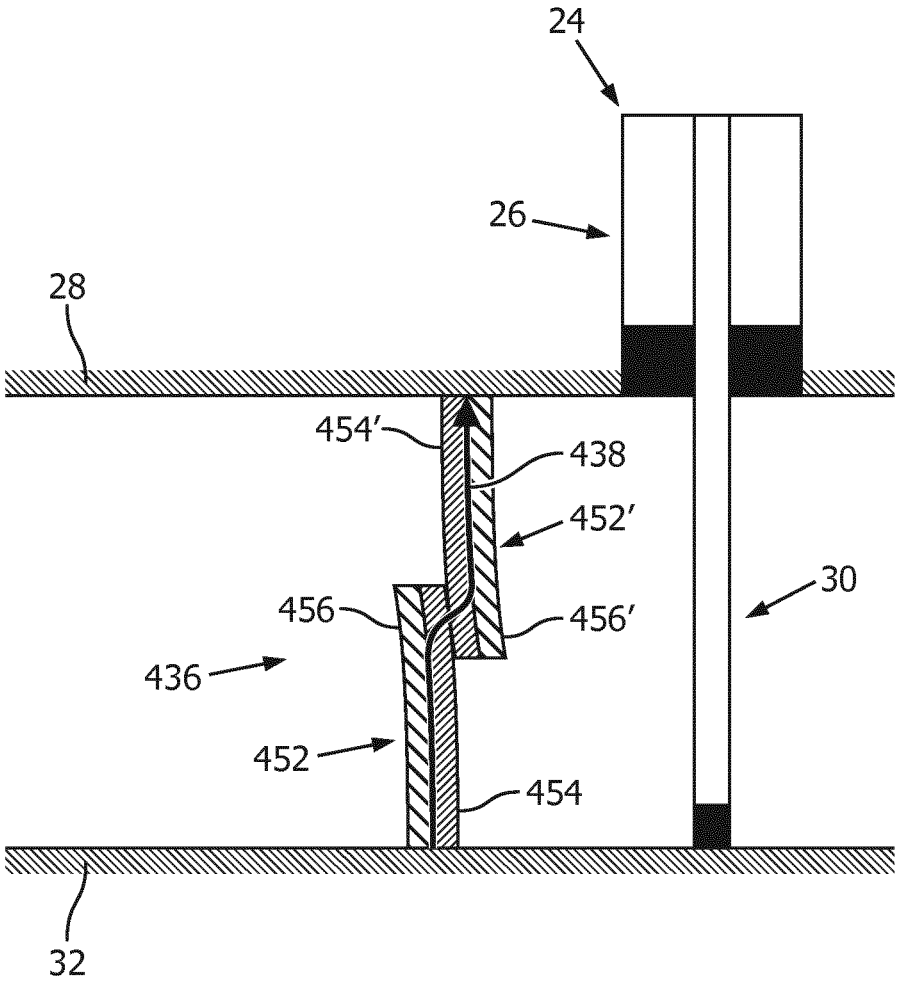
FIG. 6 is a schematic illustration of yet another alternative embodiment of a thermal connection member.

FIG. 6 is a schematic illustration of another alternative embodiment of a single thermal connection member 436 comprising two bimetal members 452, 452' formed as rectangular sheets, each bimetal member 452, 452' comprising a sheet side made of copper and an opposing sheet side made of stainless steel. Again, the cryogenic cooling system 10 may comprise one thermal connection member 436 or a plurality of thermally connection members 436.

The two bimetal members 452, 452' are arranged to oppose each other. The first end 454 of the first bimetal member 452 is fixedly attached and thermally connected to the copper flange 32 that, in turn, is thermally connected to the second stage member 30. The first end 454' of the second bimetal member 452' is fixedly attached and thermally connected to the thermally conductive link member 28 formed as a metal flange that, in turn, is thermally connected to the first stage member 26.

The second ends 456, 456' of the two bimetal members 452, 452' are configured to cooperate with their copper sides and to apply a mechanical surface pressure larger than zero towards each other if a momentary temperature of the second stage member 30 is higher than the first cryogenic temperature. A heat transfer path 438 of low thermal resistance is provided from the second stage member 30 to the first stage member 26. This condition is shown in FIG. 6. By further curving of the bimetal members 452, 452', the second ends 456, 456' of the two bimetal members 452, 452' are configured to apply zero mechanical surface pressure towards each other if a temperature of the second stage member 30 is lower than the first cryogenic temperature.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

REFERENCE SYMBOL LIST

10 cryogenic cooling system 60 gas pipe
12 cryostat
14 outer enclosure
16 thermal shield
18 inner region
20 thermal insulation region
22 superconducting magnet coil
24 two-stage cryogenic cold head
26 first stage member
28 thermally conductive link member
30 second stage member
32 copper flange
34 compressor unit
36 thermal connection member
38 heat transfer path
40 carbon fibers
42 first ends
44 second ends
46 heat conductive member
48 cut-out
50 epoxy resin
52 bimetal member
54 first end
56 second end
58 metal plate

The invention claimed is:

1. A cryogenic cooling system, comprising:

a cryostat having an outer enclosure and at least one thermal shield disposed within the outer enclosure, the at least one thermal shield defining an inner region, wherein a thermal insulation region is defined by and between the at least one thermal shield and the outer enclosure, a cryogenic cold head having a first stage member at least partially disposed in the thermal insulation region, wherein the first stage member is configured to operate in a stationary state at a first cryogenic temperature, and includes a thermally conductive link member that is thermally connected to the at least one thermal shield, at least a second stage member at least partially disposed in the inner region, wherein the second stage member is configured to operate in a stationary state at a second cryogenic temperature that is lower than the first cryogenic temperature, and at least one thermal connection member that is configured to provide, in at least one operational state of the cryogenic cooling system, at least a portion of a heat transfer path from the second stage member to the first stage member, wherein the heat transfer path is arranged outside the cold head, and a thermal resistance of the provided at least portion of the heat transfer path at the second cryogenic temperature is larger than a thermal resistance of the provided at least portion of the heat transfer path at the first cryogenic temperature.

2. The cryogenic cooling system as claimed in claim 1, wherein the thermal resistance of the provided at least portion of the heat transfer path at the second cryogenic temperature is at least 10 times larger than a thermal resistance of the provided at least portion of the heat transfer path at the first cryogenic temperature.

3. The cryogenic cooling system as claimed in claim 1, wherein the at least one thermal connection member comprises a plurality of carbon fibers, each carbon fiber having two ends, and wherein one end of the carbon fibers of the plurality of carbon fibers is thermally connected to the first stage member, and the other end of the carbon fibers of the plurality of carbon fibers is thermally connected to the second stage member.

4. The cryogenic cooling system as claimed in claim 3, wherein the plurality of carbon fibers is thermally connected to at least one of the first stage member and the second stage member by at least one force-locking connection.

5. The cryogenic cooling system as claimed in claim 3, wherein the plurality of carbon fibers is thermally connected to at least one of the first stage member and the second stage member by at least one adhesive joint.

6. The cryogenic cooling system as claimed in claim 1, wherein the at least one thermal connection member comprises a bimetal member having a first end and a second end, wherein the first end is thermally connected to the second stage member, the second end is configured to apply a mechanical surface pressure larger than zero towards at least one of (i) a heat conductive member that is thermally connected to the first stage member and (ii) the first stage member if a temperature of the second stage member is higher than the first cryogenic temperature, and the second end is configured to apply zero mechanical surface pressure towards (i) the heat conductive member and (ii) the first stage member if the temperature of the second stage member is lower than the first cryogenic temperature.

7. The cryogenic cooling system as claimed in claim 1, comprising a plurality of thermal connection members, wherein each thermal connection member comprises a bimetal member having a first end and a second end, wherein the first end is fixedly attached and thermally connected to the second stage member, the second end is configured to apply a mechanical surface pressure larger than zero to at least one heat conductive member thermally connected to the first stage member and the first stage member if a temperature of the second stage member is higher than the first cryogenic temperature, the second end is configured to apply zero mechanical surface pressure to the heat conductive member thermally connected to the first stage member and the first stage member if the temperature of the second stage member is lower than the first cryogenic temperature.

8. The cryogenic cooling system as claimed in claim 7, wherein at least one of the thermal connection members includes a plurality of carbon fibers, each carbon fiber having a first end and a second end, wherein the first ends of the carbon fibers of the plurality of carbon fibers are permanently thermally connected to the second stage member, and the second ends of the carbon fibers of the plurality of carbon fibers are thermally connected to the first stage member.

9. The cryogenic cooling system as claimed in claim 6, wherein at least one of the thermal connection members includes a plurality of carbon fibers, each carbon fiber having a first end and a second end, wherein the first ends of the carbon fibers of the plurality of carbon fibers are permanently thermally connected to the second stage member, and the second ends of the carbon fibers of the plurality of carbon fibers are attached to the second end of the bimetal member.

10. The cryogenic cooling system as claimed in claim 6, wherein at least one of the thermal connection members include a second bimetal member having a first end and a second end, and the two bimetal members being arranged to oppose each other, wherein the second bimetal member is thermally connected with the first end to the first stage member, the second ends of the two bimetal members are configured to cooperate and to apply a mechanical surface pressure larger than zero towards each other if a temperature of the second stage member is higher than the first cryogenic temperature, and the second ends of the two bimetal members are configured to apply zero mechanical surface pressure towards each other if a temperature of the second stage member is lower than the first cryogenic temperature.

11. The cryogenic cooling system as claimed in claim 7, wherein a total thickness of the at least one bimetal member is in a range between 0.1 mm and 2 mm.

12. The cryogenic cooling system as claimed in claim 1, further comprising a superconducting magnet coil that is configured to provide a quasi-static magnetic field and that is suitable for use in a magnet resonance examination apparatus, wherein the superconducting magnet coil is arranged within the inner region and is thermally connected to the second stage member, and wherein the second cryogenic temperature is lower than a critical temperature of the superconducting magnet coil.

13. The cryogenic cooling system as claimed in claim 1, wherein the thermal connection member includes a bimetallic element configured to thermally connect the first and second stage members when a temperature of the second stage member is higher than the first cyrogenic temperature and thermally disconnect the first and second stage members when the temperature of the second stage member is less than or equal to the first cryogenic temperature.

14. A cryogenic cooling system, comprising:

a cryostat having an outer enclosure and at least one thermal shield disposed within the outer enclosure, the at least one thermal shield defining an inner region, a thermal insulation region defined by and between the at least one thermal shield and the outer enclosure, a cryogenic cold head having:

a first stage member at least partially disposed in the thermal insulation region and configured to operate at a first cryogenic temperature, at least a second stage member at least partially disposed in the inner region and configured to operate at a second cryogenic temperature, the second cryogenic temperature being lower than the first cryogenic temperature, and a heat transfer path from the second stage member to the first stage member, a thermal resistance of the heat transfer path is larger at the second cryogenic temperature than at the first cryogenic temperature.

15. The cryogenic cooling system comprising:

a cryostat having an outer enclosure and at least one thermal shield disposed within the outer enclosure, the at least one thermal shield defining an inner region, a thermal insulation region defined by and between the at least one thermal shield and the outer enclosure, a cryogenic cold head having:

a first stage member at least partially disposed in the thermal insulation region and configured to operate at a first cryogenic temperature, at least a second stage member at least partially disposed in the inner region and configured to operate at a second cryogenic temperature, the second cryogenic temperature being lower than the first cryogenic temperature, and a heat transfer path from the second stage member to the first stage member, a thermal resistance of the heat transfer path is larger at the second cryogenic temperature than at the first cryogenic temperature, wherein the heat transfer path includes carbon fibers whose thermal conductivity decreases with lower cryogenic temperatures.

* * * * *